US008152643B2

(12) United States Patent
Halliburton et al.

(10) Patent No.: US 8,152,643 B2
(45) Date of Patent: Apr. 10, 2012

(54) SOLITAIRE GAME PLAYED OVER THE INTERNET WITH FEATURES TO EXTEND PLAY

(75) Inventors: Ronald D. Halliburton, Delray Beach, FL (US); Jack Pearson, Lebanon, TX (US)

(73) Assignee: Tournament Games, Inc., Hypoluxo, FL (US)

( * ) Notice: Subject to any disclaimer, the term of this patent is extended or adjusted under 35 U.S.C. 154(b) by 1898 days.

(21) Appl. No.: 10/777,770

(22) Filed: Feb. 13, 2004

(65) Prior Publication Data

US 2004/0204246 A1 Oct. 14, 2004

Related U.S. Application Data

(63) Continuation of application No. 09/828,147, filed on Apr. 9, 2001, now abandoned.

(60) Provisional application No. 60/195,217, filed on Apr. 7, 2000.

(51) Int. Cl.
*A63F 13/00* (2006.01)

(52) U.S. Cl. ..... 463/42; 463/9; 463/11; 463/16; 463/20; 463/43

(58) Field of Classification Search ..... 463/9, 11, 463/16–20, 42–43; 273/292, 293
See application file for complete search history.

(56) References Cited

U.S. PATENT DOCUMENTS 5,711,715 A 1/1998 Ringo
5,871,398 A 2/1999 Schneier et al. ..... 463/16
5,882,258 A * 3/1999 Kelly et al. ..... 463/11
5,917,725 A * 6/1999 Thacher et al. ..... 700/91
5,919,090 A * 7/1999 Mothwurf ..... 463/25
6,174,237 B1 * 1/2001 Stephenson ..... 463/42
6,196,920 B1 * 3/2001 Spaur et al. ..... 463/42

OTHER PUBLICATIONS

Worldwinner.com—Help Pages: Game Rules: Solitaire Rush Rules, retrieved from http://web.archive.org/web/20010208083939/www.worldwinner.com/cgi/rules/rules_sol.html?game_id=1 on Nov. 10, 2004, Feb. 2001, pp. 1-4.*

* cited by examiner

*Primary Examiner* — Peter DungBa Vo
*Assistant Examiner* — Sunit Pandya
(74) *Attorney, Agent, or Firm* — Andrew C. Aitken

(57) ABSTRACT

The present invention provides a method for playing a computer-based solitaire game including the steps of retrieving an input from an internet server to a computer, playing and scoring the game according to the input. The internet server and the computer are intermittently connected during the game and the input comprises a scoring method and a game pattern which are controlled and predetermined by the internet. The present invention also provides a computer-based solitaire game comprising a network connection to an internet server for retrieving an input and for comparing scores, and a control system for a player having means for operating on the input and means for displaying the input and the comparison results to the player. The input comprises a scoring method and a game pattern which are controlled and predetermined by the internet server, and the game pattern comprises game features and graphic elements. The present invention further provides a method for operating a tournament game over the internet having the steps of establishing communication between a central server and a player's computer, downloading an input onto the player's computer, re-accessing periodically to the player's computer from the central server, transferring information relating to player's identity, the game, and result to the central server, comparing scoring results from multiple players in the central server according to the tournament structure, displaying the comparison results on the player's computer, and continuing playing the game according to results and the tournament structure.

29 Claims, 14 Drawing Sheets

SOLITAIRE GAME PLAYED OVER THE INTERNET WITH FEATURES TO EXTEND PLAY

CROSS-REFERENCES TO RELATED APPLICATIONS

This application is a continuation of and claims the benefit of the filing date of U.S. patent application Ser. No. 09/828,147 filed Apr. 9, 2001 by Ronald D. Halliburton et al, entitled "Solitaire Game Played Over the Internet With Feature to Extend Play," and also claims the benefit of the filing date of U.S. provisional application 60/195,217, filed on Apr. 7, 2000.

BACKGROUND OF THE INVENTION

This invention relates to new methods of playing solitaire, and more particularly, to an electronic method of playing solitaire incorporating new features which allow the game to be played on the Internet in a tournament format and also increase player enjoyment.

Solitaire is a popular card game which is designed to be played with conventional playing cards by a single person. The object of solitaire, in most variations, is to play all of the cards in the deck according to the rules of the game. To set up the conventional solitaire game, sometimes referred to as the Klondike version, a series of seven stacks are created in a row, with each stack containing a progressively larger number of cards. Typically, the stack on the far left side of the array contains a single card and the remaining stacks have an incrementally increasing number of cards. Thus, in the foregoing arrangement, the seventh stack contains a total of seven cards, the sixth stack contains six cards, etc. The top card of each stack is positioned face up and visible to the player. In the event any ace is revealed during play, the ace may be used to begin one of four additional stacks, with one additional stack for each of the respective suits.

The rules of the game require the player to play cards in descending order on the seven stacks with alternating colors (red and black) on the seven stacks of columns. Cards are revealed one at a time from the top of the play deck containing the remaining unrevealed cards, or in another version of the game, every third card in the play deck is revealed. The newly revealed card is either placed on one of the seven stacks, one of the ace stacks or placed on the discard stack. The bottom card facing up on the stacks, with the remaining face up cards on the stacks, may also be played from stack to stack. In the event all face-up cards are played from one stack to another stack location, if there is an unrevealed card under the stack from which the cards are moved the card under the stack may be turned face-up and revealed. In the event a king is revealed, the king may be used to create a new stack, if there are less than seven stacks in the seven-stack array. If an ace is revealed, the ace may be played to create an ace stack. Cards matching the suit of an ace stack may be played on the respective ace stack in ascending order.

The object of the game of solitaire is to play all the cards so that, through the application of judicious strategy and luck, the game concludes with all fifty-two cards on the ace columns. Often, the game will end prematurely because all possible moves have been exhausted. If the player succeeds in playing all the cards onto the ace columns, this accomplishment is commonly referred to as "busting the deck."

There are a number of versions of electronic solitaire games, which are designed to be played on personal computers, which follow the conventional rules as described above.

A first class of such solitaire games is designed to be played entirely on a single personal computer and does not involve competition with other players at remote locations. Solitaire card games played on a personal computer have a number of features, which distinguish the games from conventional solitaire. For example, electronic solitaire games will frequently incorporate a timer feature which allows a player a predetermined amount of time in which to make a particular play. In the event a card is not played within the predetermined time interval, the next card in the play deck is automatically revealed. A card is moved on the play field to a desired location by manipulating the mouse and dragging the selected card to the new location. In the event a player attempts to improperly play a card to or from a location, the card is automatically returned to its original location.

The advent of the Internet has provided an opportunity for competition by a wide number of individuals at diverse locations. In order for a game to be successful on the Internet, the game should be easy to understand and play and should allow players to exercise skill. Because solitaire is well understood by so many people, the game is particularly suitable to be adapted for tournament play over the Internet. Since many people have some basic familiarity with the game, large numbers of people can immediately play without the need for extensive learning or training. The Internet allows a provider to establish a tournament, which allows a number of players to compete against each other. For example, solitaire games may be played simultaneously by many players over the Internet and their scores can then be posted to a central site. Winners may be declared as those with the highest score within a particular frame of time.

In order to accommodate a large number of players simultaneously playing in a single tournament, the tournament format should have the capability of awarding a wide range of scores in a given event. In order to adopt computer-based solitaire games to an Internet-based tournament format some additional features have been incorporated into the software. For instance, one feature effects communication from a personal computer to a host server to report the score of the player and receive data from host site. Such data received from the host site may include the information relating to the card sequence which is dealt to the player, information relating to the tournaments which are presently available for the player to play, the status of certain tournaments and standings, and the player's account information.

One problem with conventional versions of electronic-based solitaire is that the games frequently allow only a small number of possible moves due to the card pattern of the deal. This situation is referred to as a short deck. In such situations, the player is dissatisfied with the game because the game ends quickly and consequently, the player may lose interest in playing additional games. Furthermore, in conventional solitaire, because the score of the game is highly dependant on the luck of the draw—as opposed to the skill of the player—, there may be legal implications when a player pays to play games and prizes are awarded for high scores. In order to address the problems with a short deck, some games employ the concept of "seeded decks," which describes decks of cards, which will contain a predetermined minimum number of possible moves. Decks, which do not meet the criterion of containing the predetermined minimum number of moves, are discarded and not distributed to players.

As mentioned above, a further feature required for tournament play is the ability to generate a wide scoring spread among players. One manner to increase the scoring spread is to base the score on the speed of play. In this regard, the score of a successful move can be based, in part, upon the time it takes a player to successfully execute a move. Using speed of play to score has a further advantage because it injects a skill element into the game. Using the speed of play as a scoring function can provide a wider scoring spread; however, it does not contribute to extend the duration of the game.

It is an object of the present invention to provide a version of electronic solitaire which can be played over the Internet which incorporate features which allow for longer play and an increased number of possible moves. It is a further object of the invention to reward the player for the exercise of skill, provide for a wide scoring spread, and generally provide new features to make solitaire games more interesting to play.

SUMMARY OF THE INVENTION

The present invention is directed to new features for electronic solitaire games, which are played over the Internet in a tournament format. In one of the preferred embodiments, the score for each successful move is in part dependant upon the time in which the player makes a successful move. In a second embodiment, the score is principally based on the number of moves successfully executed, with each move made within a predetermined time period. The new features include a "wild card" option, a "target" option, a "future play" option, an "ace count down" bonus option and the incorporation of "multiple play decks." These features either provide new methods to score in a solitaire game and therefore increase the scoring spread and/or provide for games which have a longer duration, and increase the chance a player will "bust the deck." By combining these new features in various combinations, a wide number of new games can be created. New tournament formats are also disclosed herein including a "Sprint" Game, a "No Clock" game and a "First to Bust the Deck" game." A further tournament option is a "Rookie Game" which is limited to players who have not won a tournament. These new features, scoring methods and tournament formats allow players to exercise more strategy and consequently generate more player interest in the game than do conventional electronic solitaire games. The features enhance the play of solitaire on the Internet in tournament formats and provide more opportunities for a player to exercise skill. Because the use of the features is recognized in the scoring scheme, the spread between final scores in individual games is increased.

DETAILED DESCRIPTION OF THE INVENTION

Figure 1:
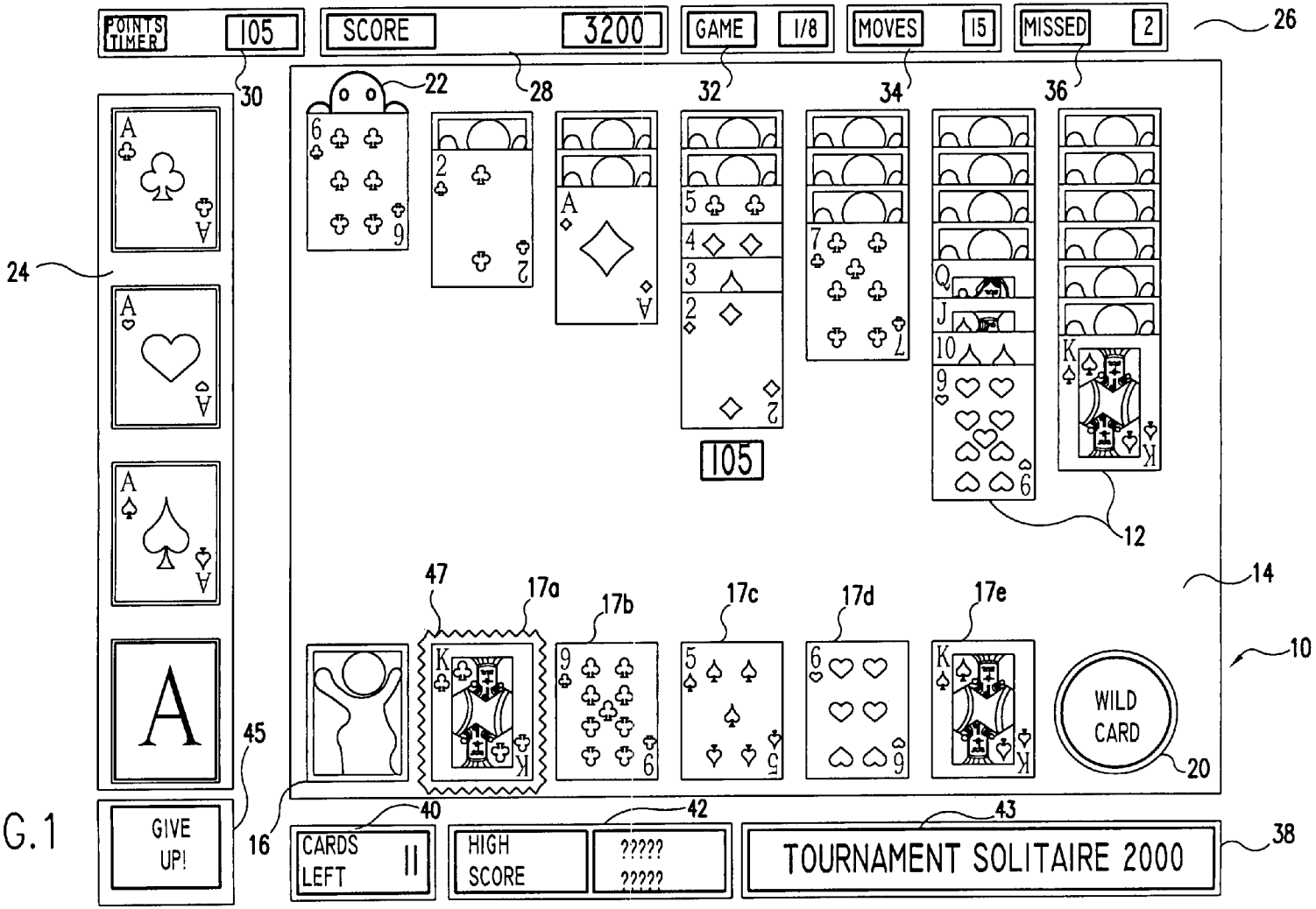
FIG. 1 is a first screen display according to a first embodiments of the present invention showing an example of a version of the game employing multiple discard decks, the wild card feature and the target feature.

The present invention relates to computer solitaire games, which are adapted for tournament play over the Internet. Each of the games described below begins by dealing twenty-eight cards to the play field 14 in seven columns. The games are played according to the rules of the classic Klondike solitaire game. In a first embodiment scoring is principally determined by the speed of each successful play, plus any bonus which is provided. Now referring to FIG. 1, a display screen 10 is depicted for play of solitaire on a personal computer, having a series of seven columns of playing cards 12 on a play field 14. The top card on each column is depicted face up. On the lower section of play field 14 is a play deck 16 from which cards are sequentially revealed. Adjacent to the play deck there is depicted a series of five play stacks 17*a-e* with the top card of each stack revealed. In the right-hand corner of play field 14 is wild card icon 20.

Also depicted on the play field 14 is the target indicator 22 which is in the shape of a head and two paws and is located behind the six of clubs. When the target indicator feature is activated, a bonus score is awarded upon the removal of all the cards directly in front of the target indicator. The bonus score associated with the target indicator may have a fixed value or a dynamic value, which decreases with time. When the bonus score has a dynamic value there is an incentive for the player to expose the target indicator at an earlier rather than later time in the game. The location of the target indicator with respect to the columns is randomly provided to the player along with the card sequence.

To the left of play field 14 is the ace field 24 where four locations are provided on which aces may be played, followed by cards of the corresponding suit in ascending sequential order. In the preferred embodiment successful play to the ace field is awarded three times the countdown timer value. An additional scoring feature, which may be activated, is referred to as the ace countdown bonus. This further feature rewards the playing of an ace on the ace column at an early time in the game. In versions of the game using this scoring feature, a point value is displayed over each of the empty aces in the ace column and the value decreases with time. When an ace is played, the bonus point value, which is displayed, is added to the score.

On top of play field 14 is top score board 26. Top score board 26 includes a countdown timer 30, a total score box 28, a game indicator 32, a move indicator counter 34 and a miss indicator counter 36. Total score box 28 keeps a running tally of the score of the game, which is currently being played. The countdown timer in the preferred embodiment starts at 200 and rapidly counts down to zero. In a preferred embodiment the player has approximately seven seconds to make a play or the next card in the play deck 16 will be turned and revealed. When the countdown reaches a count of ten (or when there is approximately one second remaining in which to make a move), an audio signal is generated to alert the player. When the countdown time has elapsed, the next card from play deck 16 will be revealed and made available for play. Cards are dealt first to play stack 17*a*, then to play stack 7*b*, and so on continuing to stack 17*e*. The game is then programmed to distribute cards in a manner to try to keep the number of cards in the respective stacks equal.

A frame indicator 47 in form of a bright yellow outline is displayed around the card, which was most recently distributed from play deck 16. The frame indicator allows a player to quickly determine which card is new and may allow a player to predict where the next card distributed card will be placed. The move box 34 tracks the total number of successful moves made by a player in a particular game and the miss box 36 tracks any scoring moves that the player missed.

Bottom score board 38 contains a "cards left" counter 40, a high score indicator 42 and a scrolling banner box 38. In the bottom left hand corner is a give-up box 45, which stops the game. The cards left box indicates the number of cards remaining in the play deck 16 for the particular game. The high score box provides information relating to the highest score posted in the tournament which the payer has entered and is downloaded from the server at the time the player selects the tournament. The scrolling banner also contains information downloaded from a server and can display information relating to the tournament, such as the ending time, or other information such as advertising.

A paramount objective in playing a solitaire game is "busting the deck" or moving all the cards to the ace columns. It is estimated that a good player will bust the deck approximately one time out of fifty games played in a conventional solitaire game. One of the inventor's principal objectives in the creation of the present invention was to determine manners in which to increase the chances that a player would bust the deck. One manner in which to achieve this goal was to increase the number of possible moves at a given point in the game. By increasing the number of possible moves, the chances are increased that a player will bust the deck. A first manner to achieve this objective is to provide the player with multiple play stacks from which cards may be played, the exact number of which is controlled by the game server. The server, according to the invention, may provide from between one and five play stacks, depending on the games available and the games, which are selected from the menu.

The game presented in FIG. 1 depicts a five-stack game with both the wild card 20 and target feature 22 activated. The five-stack game allows play from any one of the five stacks 17*a*-17*e* on the bottom of the play field to either one of the seven columns 12 in the play field or to the ace field 24. Play is effected by moving an indicator with the mouse over a selected card and depressing the selection button on the mouse. The indicator is then moved to the desired play location and the activation button is again selected. If the selected location is a proper play according to the rules of the game, the card will move from the initial position to the selected location and a score will be awarded. Cards may also be played from the columns to the ace stacks and from column to column according to the conventional rules of solitaire In the embodiment depicted in FIG. 1 each successful move is scored based upon the elapsed time, as indicated by the time remaining on the points timer 30, plus any bonus which may be in effect. For example, FIG. 1 depicts a score of 105 for the successful play of the two of diamonds onto the three of spades with no bonus awarded. The score for each particular play is displayed at or near the location where the play was made. In the preferred embodiment, a successful play to the aces column is awarded three times the countdown value displayed at the time the card is played, plus any bonus. In conventional solitaire, the play must be from a single play deck. By increasing the number of decks to multiple numbers of play decks, the chances that a player will bust the deck also increases.

Referring back to the top scoreboard 26 and more particularly game indicator 32, the game depicted in FIG. 1 is the first game of a three-game tournament. Move box 34 reflects that the player has made fifteen successful moves and box 36 indicates the player has missed two point-scoring moves. When a potential play is missed, an audible signal is generated. In the event a player attempts to make an improper move, a different audible signal is provided and the card is returned to the location from which it originated.

In a preferred embodiment, when a card is first revealed and accessible for play or to be moved a timer starts counting down from a value of 110 to a value of zero over a period of approximately seven seconds. This timer resets to 110 each time a player makes a successful move. When a player makes a successful play the number of points awarded is equal to the timer value at the moment the play is completed. If it takes a while for a player to recognize a possible play and then make a play; the timer may count down to a low value, e.g., 10, in which case the player would only score 10 points for that play. If a player quickly recognizes and completes a play, the player's score is higher. In the course of a game, a fast player may score several thousand points more than a slow player. There are other features that can add to a player's score, discussed in further sections.

Another manner in which to increase the possibility of busting the deck and generally extend the length of a game is the incorporation of the wild card feature. The wild card feature allows a player to select the wild card icon 20 and play the icon on any of the stacks or to one of the ace columns at any time during the game. The program for the wild card feature determines the possible cards, which could be played at the desired location and then first scans the play deck 16 and then the column 12 for the first card, which can be played in the selected location. In the event a card is located in one of the columns a marker is inserted at that location. In the event that the location where the marker has been placed is later revealed during play, the program is instructed to reveal the next card in the column. If the only cards, which can be played at the desired location, are in the ace columns or is exposed on the play field then the wild card cannot be played. If the player attempts to play the wild card feature and the wild card program determines that no card can be played, the wild card icon will not be removed. When the wild card feature is enabled, the player will get one wild card per game. The player can play the wild card at any time during the game. If the wild card feature is activated and the player does not use the wild card, the player will collect a 500-point bonus at the end of the game. The rationale behind this scoring scenario is to provoke thought by the player on how and when to use the wild card. If the wild card is used and it only gains the player 100 points then the player made an unwise decision because 500 points would have been gained by not playing it.

Figure 2:
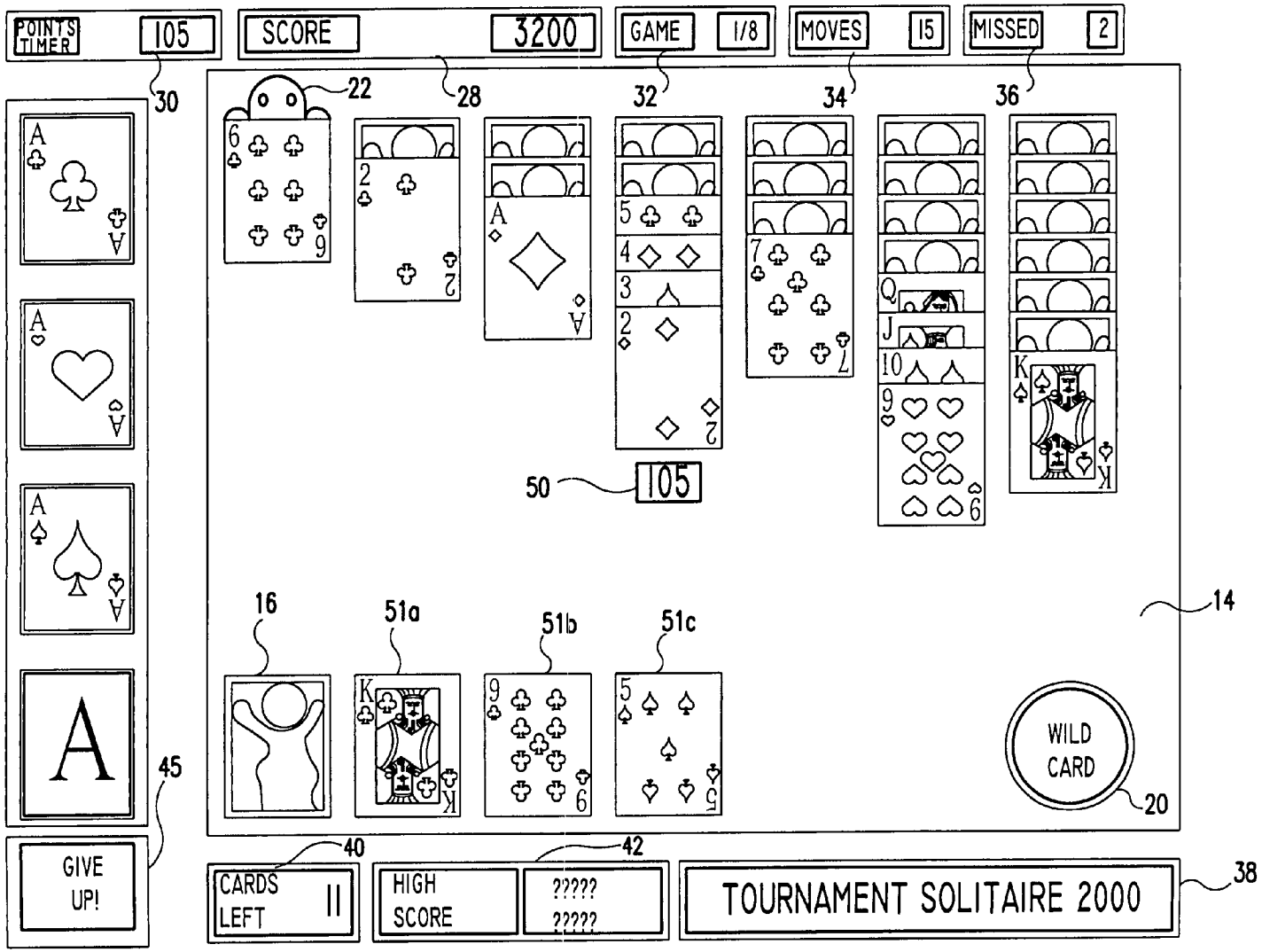
FIG. 2 is another screen display depicting an example of a version of the game employing three discard stacks.
Figure 3:
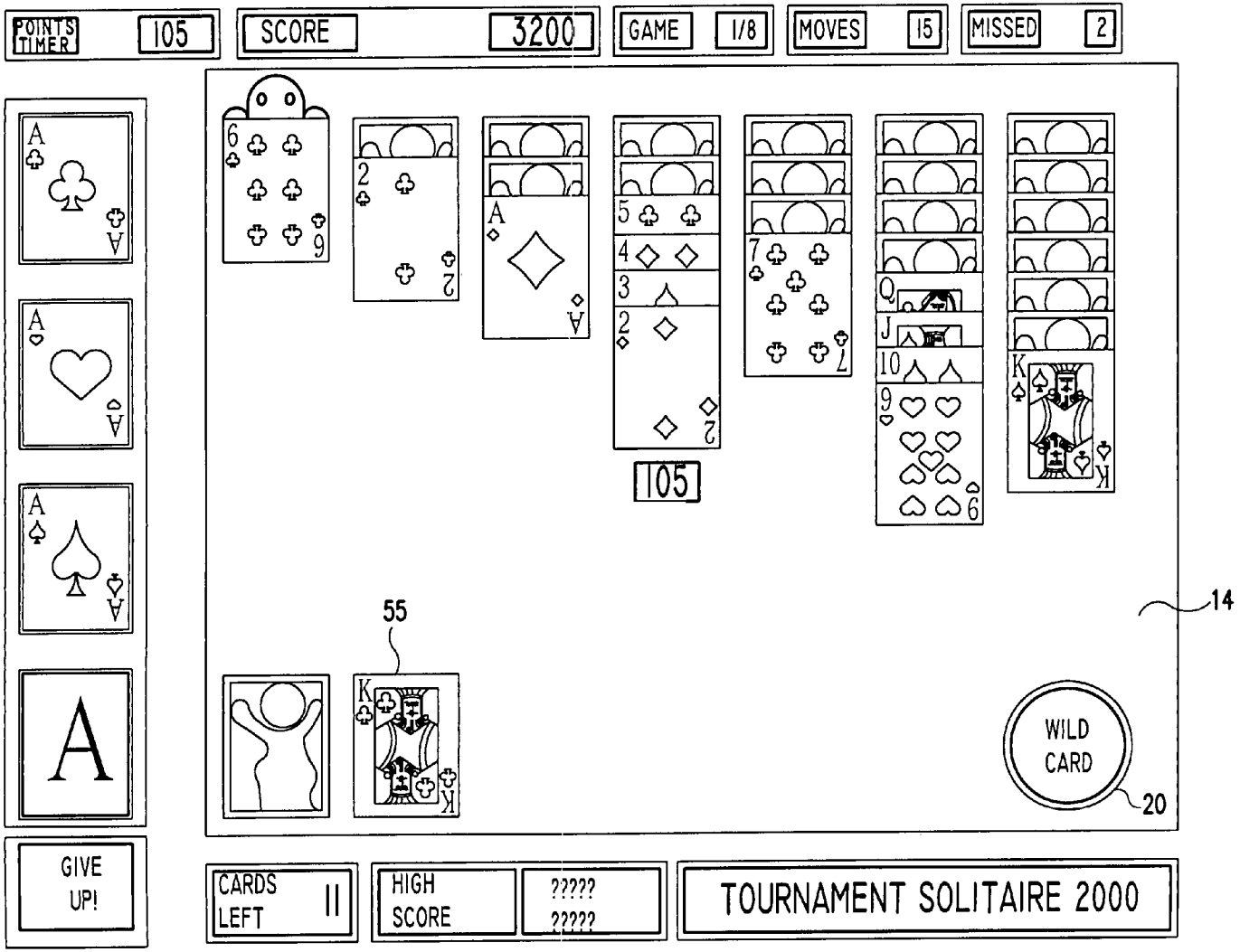
FIG. 3 is another screen display showing an example of a version of the game employing a single discard deck, the wild card feature and the target feature.
Figure 4:
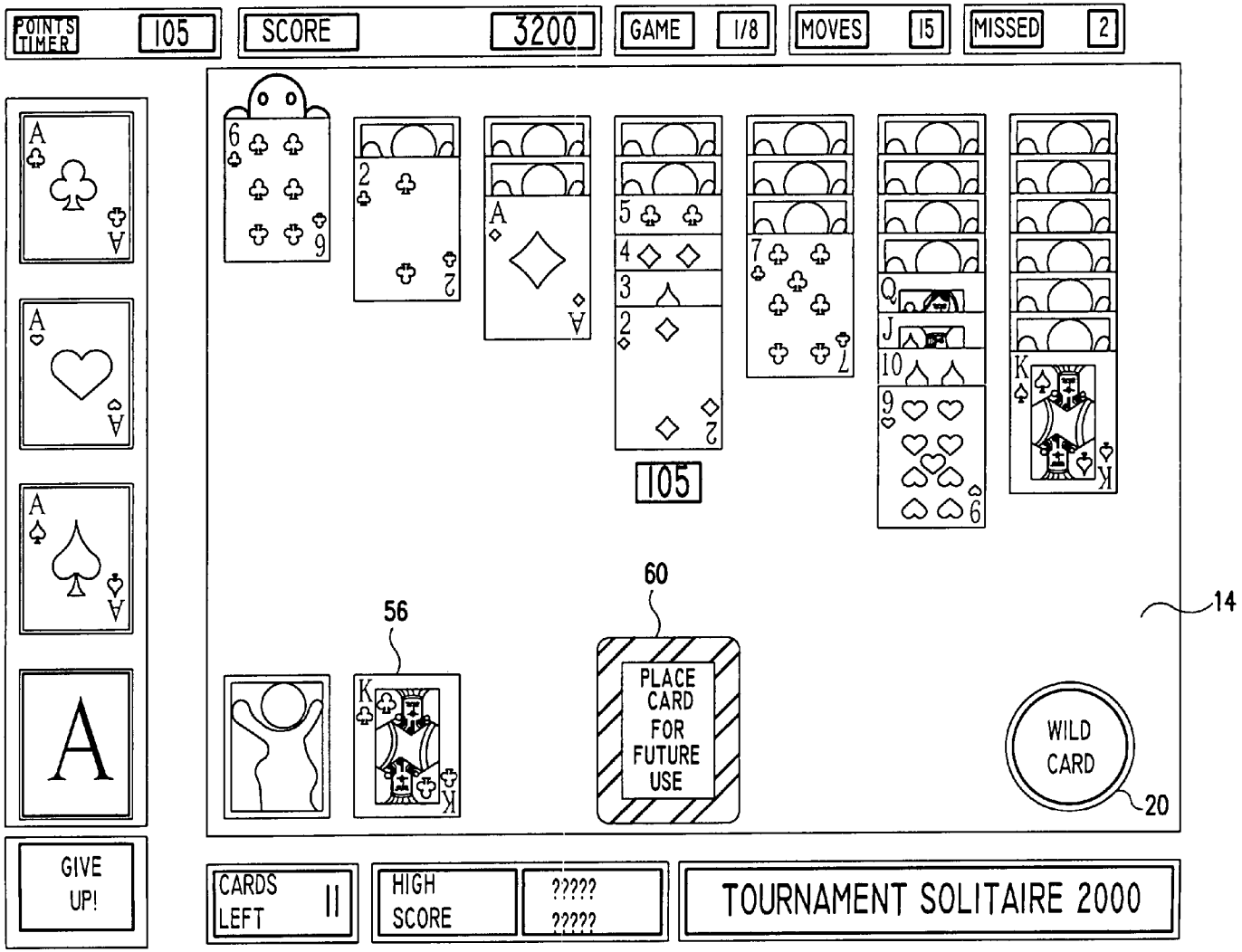
FIG. 4 is another screen display showing an example of a version of the game employing the future play feature.

FIG. 2 shows an alternative embodiment of the game in which there are three play stacks rather than the five depicted in FIG. 1. FIG. 3 depicts a screen where there is only one discard stack with the wild card feature activated. FIG. 4 depicts a screen display providing an area 60 onto which a player may place a card from the play stack for future play. This feature allows a player to select a card from the play stacks and move the card to the future play area. Only one card at a time may be held in the future play area. In the embodiment depicted in FIG. 4 the area is open and can receive a card. Cards may be moved from the future play area to the play field or ace columns according to conventional rules.

Figure 5:
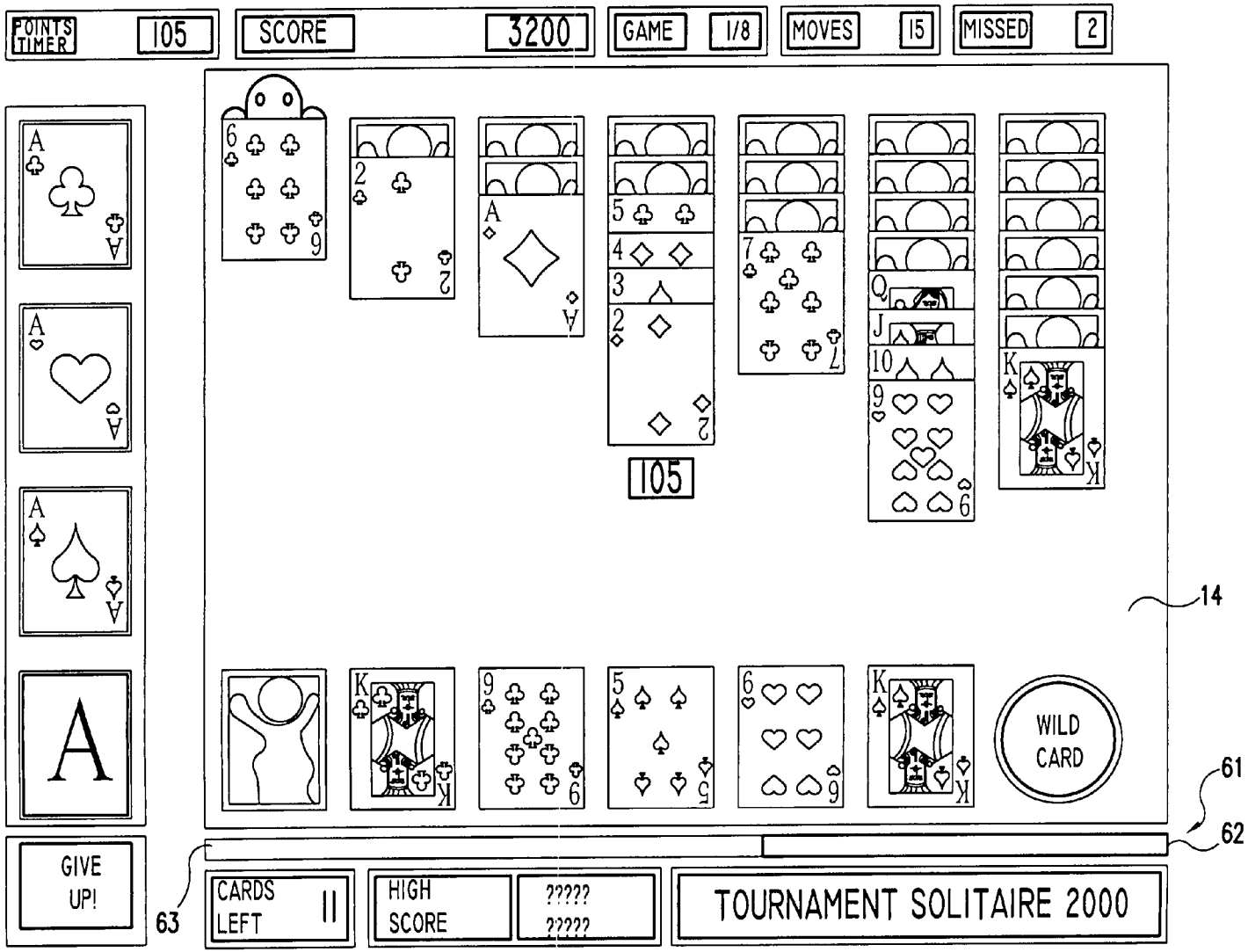
FIG. 5 is yet another screen display further incorporating a visual graphic representing the elapse of time for each card.

FIG. 5 shows a screen display like FIG. 1 with a further feature of a bar graph 61 which is displayed below play field 14. Bar graph 61 moves at a constant rate in conjunction with changes to the points timer and provides an easily recognizable visible display of the elapsed time and time remaining for each card's play. The bar graph allows a player to observe the time remaining by using his or her peripheral vision in a form, which is easier to quickly conceptualize than is the numerical points, countdown display. As time elapses, the portion 63 of the graph decreases and the portion 62 of the graph increases. The bar graph allows the player to comprehend the time remaining while simultaneously concentrating on the play field.

When a player successfully plays all fifty-two cards in the ace column, the situation is called a "busted deck." In a preferred embodiment, when this event occurs an animation is displayed and the player receives a 100 point bonus for each card played, or 5200 points.

Figure 6:
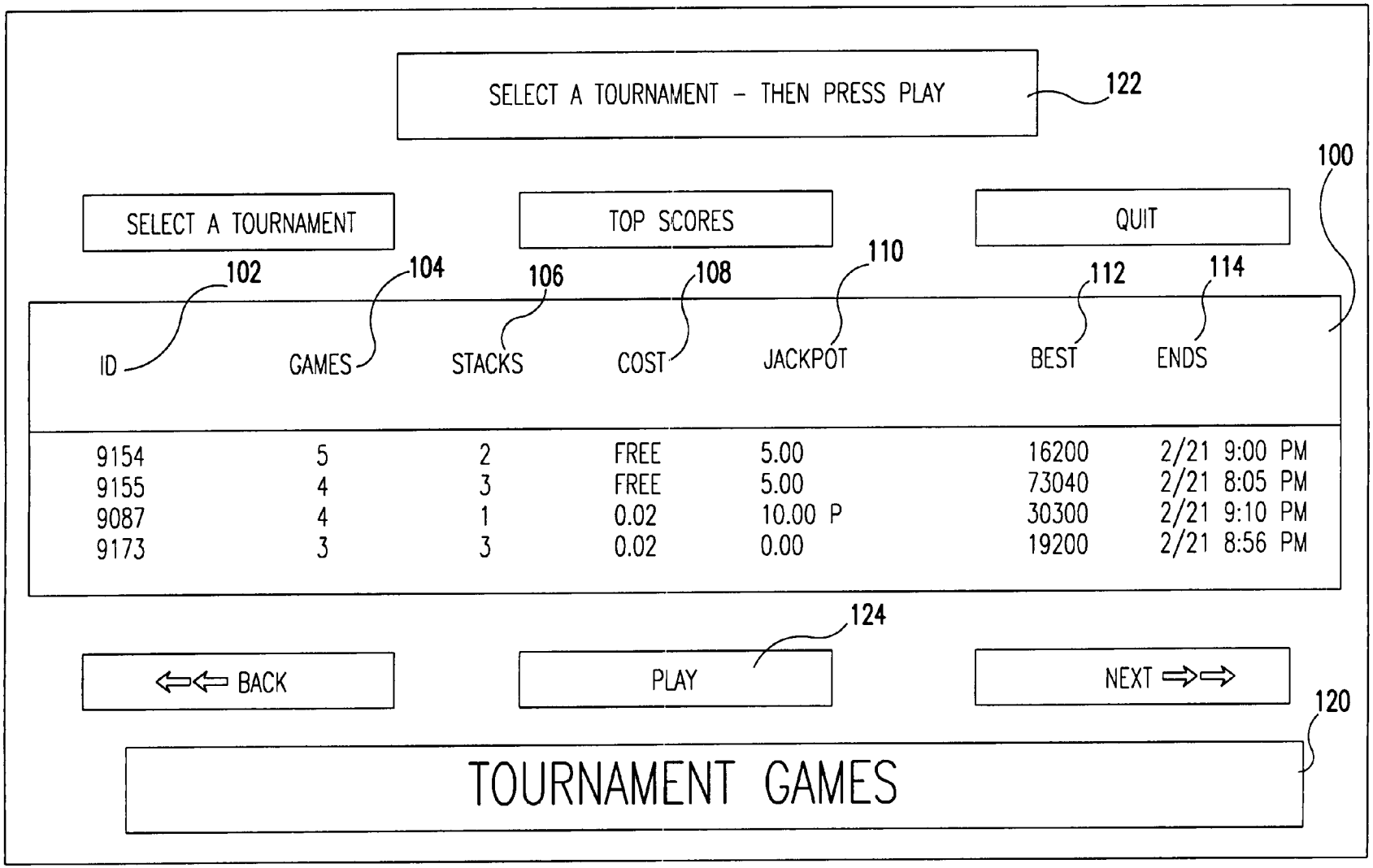
FIG. 6 is an example of a game selection display.

FIG. 6 depicts a screen display, which sets forth information regarding the tournaments in progress and scheduled games. Window 100 contains data, which is updated by the server, while the remaining portion of the display is part of the control software, which is downloaded with the game software. The data in window 100 includes a column 102 which depicts an identification number for each game, column 104 which identifies the number of games each player must play in the tournament, column 106 which identifies the number of play stacks in the game, column 108 which specifies the cost of playing the game, column 110 which identifies the jackpot for the tournament, column 112 which identifies the current high score, and column 114 which identifies the ending date and time of each tournament. Field 120 is reserved for advertising space. Field 122 instructs a prospective player to select one of the available tournaments; the selection is made by highlighting the line using the mouse pointer. Upon selection of a game, the player moves the cursor to the play button 124 and depresses the selection button on the mouse. Upon activating the play button the program is instructed to contact the web server with information relating to the selected game. The web server then "provides" the cards by providing a seed number and other information relating to the features, which are to be activated in the particular game, selected. After a brief interim period, characterized by "dealing" the play deck to set up the columns, play begins. Since the player can watch the deck as it is dealt, the player can plan the first few moves before control by the player and the countdown timer count actually begin.

The program for the game and necessary control features which enable communication with a central server are downloaded to the player's personal computer. The activation of the various features on the players personal computer is controlled by the server. In order to ensure that contact is not lost with the player's Internet Service Provider, the program is instructed to periodically re-access the host server between games.

There are a number of tournament structures provided. In a first structure, the player with the highest point value after a predetermined time period has elapsed wins the tournament. In another tournament format, referred to as the Sprint format, play progresses until the first player exceeds a predetermined score. This score can be calculated in a manner, which will only be exceeded if a player busts the deck and thus the subversion of the sprint game is the "first to bust the deck game." The first to bust the deck game may be continuously repeated with a new tournament beginning as soon as a player breaks the predetermined score. In yet another scoring variation referred to as "no clock" scoring, a player has a predetermined length of time in which to make a successful play and each successful play is credited with a predetermined non-decreasing point value. In this variation, a player must make a play within the predetermined period or the next card will be flipped from the play deck; however, the rapidity of play is not determinative of the score. In an embodiment of this game each play to the seven-stack array is worth 200 points and each play to the aces column is worth three times the value, or 600 points. In this No Clock embodiment, there is an incentive to move long columns because each card in the column has a value of 200 points. For example, if there are two cards in a column, which is successfully moved, the player scores 400 points. In yet a further tournament feature is a first to bust the deck tournament. This tournament starts upon each time a player reports that the deck has been busted. In yet a further tournament format, the tournament is limited to players who have never previously won before. The format may be policed by only allowing those with register under their own name and who provide an address in order to receive cash prizes. In the event a player enters under a false name, the check will not be forwarded to the correct individual.

The game pattern includes game features and graphic elements of the game that are displayed on the desktop to the game player. The activation of game features and graphic elements, including the play field background and the card back graphics, is controlled by the game server so as to control the general appearance of the game. Present on the desktop software are the game play features, which are controlled by the game server and described below. By activating various combinations of these game features it is possible to create multiple variations of the games. Altering the features and graphics as well as providing different tournament formats helps to prevent players from getting tired of repeatedly playing the same game. The graphics may also be used to display advertisements and serve as an additional source of revenue.

A further feature of the invention is its ability to work effectively with low bandwidth Internet connections. As explained above, the game software is downloaded one time from the web site and resides on the player's personal computer. The data passed between the player's computer and the game server consists of relatively small packets at intermittent time periods after the conclusion of each game. When a player initially logs onto the web site a relatively small packet of data, which primarily includes information relating to the identity of the player, is transferred between the player's computer and the game server. The server then transfers back information relating to the player's account, and updated information relating to the tournaments in progress at that time. Upon the selection of a tournament by a player and after activating the play button, the server transfers data including instructions on which features will be activated for the selected game, the card sequence, the location of the target bonus, and any screen updates such as graphics or advertising material. The sequence of the cards provided to the player for each game is determined by the transfer of a "seed" consisting of a random number, which is generated by the server. This concept is well known in the art. The sequence of cards is not technically preselected but is computed on the player's computer by an algorithm dependant on the seed.

The server is a HTTP server running a custom extension (ISAPI) that processes the game server requests. The game client is essentially a web browser that is only useful at the host site and can communicate with the extension.

After the software on the player's computer has been initialized, play of the game is initiated. To provide a transition time and to enable the player to prepare to make the first play, the program depicts both sound effects of the shuffling of the decks and a visual display which shows the cards being distributed across the play field. Upon completion of the deal, play may be initiated. During game play no data is passed between the player and the game server so a low bandwidth connection does not slow down or affect game play. The game will play just as well on a 14.4 Kbps connection as on a T1 connection. After each game is completed, a data transfer occurs between the player's computer and the game server. The player's custom browser contacts the server again and reports the score. Data transferred includes information relating to the players identify, the game and tournament selected. If the player posts a winning or leading score, the player's browser is also requested by the server to send information relating the sequence of play and the time which had elapsed between each play. This procedure is a security measure and is designed to ensure that players have not tampered with the program. The moment of time the player was provided the play deck seed can also be compared to the moment of time the game was completed. In the event the duration of play is longer than the expected duration in view of the score, the sequence of play can be further scrutinized by the web host to ensure there was no fraud. Scores, which are returned reporting an unreasonable amount of time, are rejected. This time period will vary depending on the number of games and the type of games played in the respective tournament.

Figure 7:
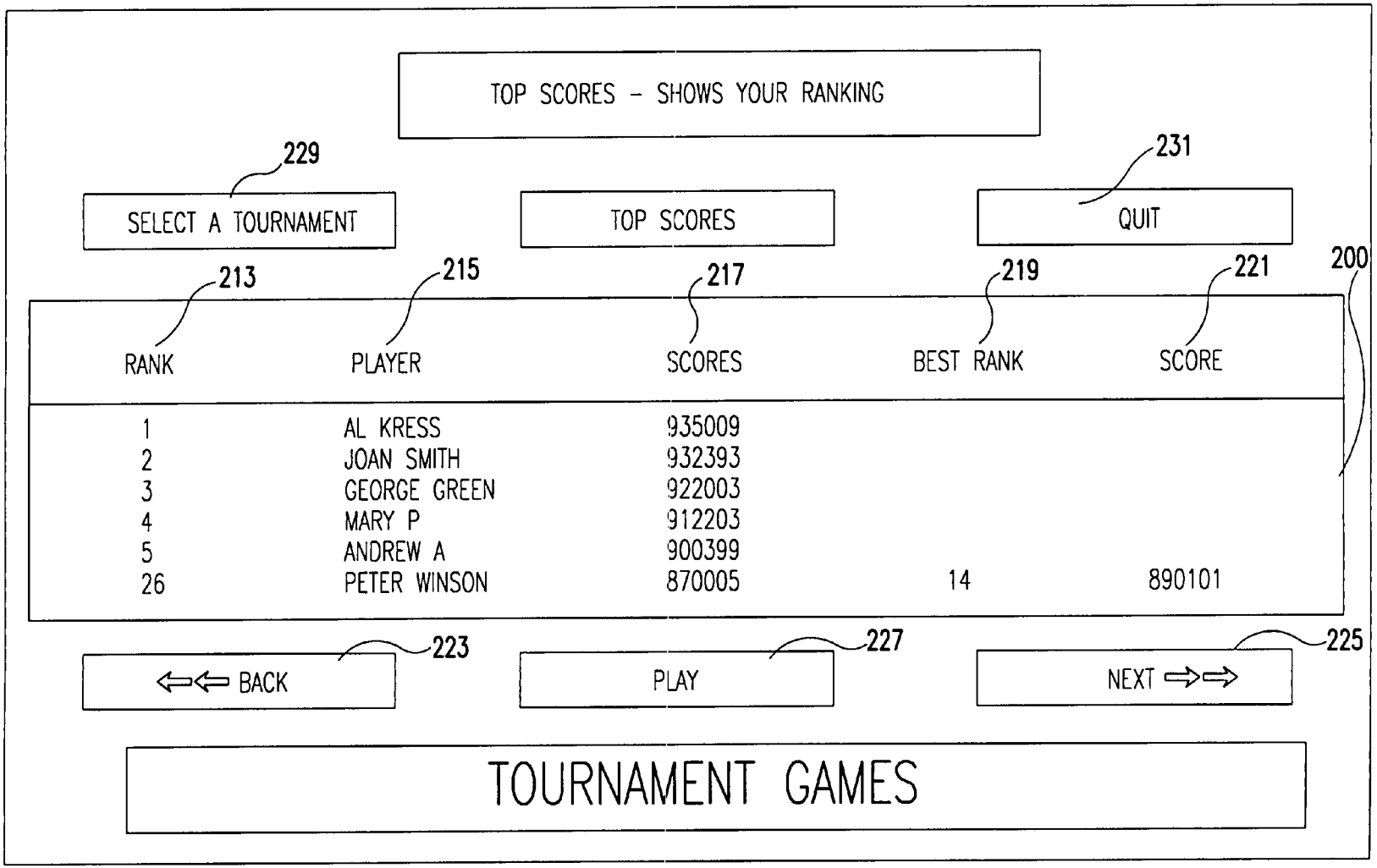
FIG. 7 is an example of a game statistic display.

After each tournament is completed the final results of the game played are passed to the game server. The player's score is posted in the tournament database, sorted with all the other tournament scores and the player's rank is sent back to the player for displayed so the player can see how that game ranked with other games in the tournament. FIG. 7 depicts an illustration of a screen display, which displays the scores. Window 200 provides data relating to the scores of the current top five players and the scores of the player. Directly underneath the top five and provided in a different color is the player's rank in a rank column 213, player name column 215 and player score column 217, as well as the player's best rank in column 219 and best score in column 221. The back button 223 and next button 225 scroll the information: in window 200. Play may be initiated by activation of play button 227. If the player desires to switch windows to the select tournament window, the player may activate button 229. To quit the game, player activates quit button 231.

In the event the player posts a top score, defined as the highest, further information relating to the timing and sequence of the play of the game is also transferred to the server. This feature, as alluded to above, serves to detect fraud because the timing and sequence of each of the players' moves are recorded and then transferred to the server upon demand. If the score is a top score the game details can be examined in detail to determine if the high score was the result of an automated game-playing program as opposed to the manual manipulations by a human player. A fraud detection feature of the game server can be programmed to flag and therefore examine scores, which are a predetermined minimum number of points higher than an existing high score. If a suspicious score is detected, the sequence and timing of the game can be examined to attempt to determine if the integrity of the game was in any manner compromised.

In the present game the ability to have a wide score spread is possible and consequently numerous players can be accommodated in a single tournament. The accommodation of a large number of players is further effected by the intermittent manner in which the players communicate with the host server. In view of the possibility that a very large number of players would participate in a single tournament, a scoring resolution higher than that in a conventional solitaire game was necessary in order to provide maximum score differentiation. In this regard, a game server can accommodate many more players than would be possible if the communications between the player and the server were more frequent. It would be unsatisfactory for a large number of players to tie for first place or other top places so additional scoring features are incorporated into the game to further discriminate the scoring.

If a player wants to give up during a game, the player can select the Give Up button 45 and the game in progress will end and the next game will begin if there are any games left in that tournament. A method is also provided whereby the player can exit the whole tournament rather than just the one game. This is done by pressing the <ESC> key on the keyboard. This can be used by someone playing at work when they need to exit the game quickly. The Give Up and Escape features allows a player who is playing in a multiple game tournament to give up upon making a determination that his or her score will not be able to win the overall tournament. For example, if the high score listed is 50,000 points, a player may know that in order to reach 50,000 points he or she must bust two decks. If the player completes the first game and does not successfully bust the deck, there is no incentive to play the second game because at that point it will be impossible to beat the high score. The player can then choose to activate the ESC key and end the tournament. Players may end a game or tournament anytime they do not like their hand or if they think they have no chance to surpass the highest score. By prematurely ending the low-scoring games, they can make more attempts to beat the top score in a given length of time. For example, by judiciously using the Give Up button and the ESC key a player may be able to attempt eighty games in one hour as opposed to only fifty if the games are played all the way through to completion.

There are some scoring features that are not apparent when a player first plays the game and must be learned. These features are not explained in the instructions or directions to the game. It usually takes the players a while to deduce these features and thus a player who plays the game repeatedly is rewarded for his or her effort. For example, to play to a column, the mouse icon does not have to be positioned directly on the location where the card will be displayed but can be anywhere in an area vertically aligned with the column in the play field. Likewise, to play to the ace field, the mouse icon does not have to be located directly over the intended stack but can be positioned at any location in the ace field. These features allow a player to execute moves faster and consequently, players that learn and use these features can achieve higher scores. Another way to increase the score is to play to the columns before the ace stacks and make a double play. For example, if a red ace is turned over in the stack, the player's initial thought might be to move it to the ace column as soon as possible. But a player can score higher if he or she first moves the ace onto a black two on the play field then move the ace to the ace column. This could earn the player around 400 points instead of the 300 points that would be earned if the ace were played directly onto the ace column. This move not only works with an ace but with any card that can indirectly be played to the ace column.

Another feature to increase scores is to activate the Give Up button as soon as he or she has determined that there are no more moves the player will collect the points remaining on the timer.

In order to play the Internet tournament version of the game, the player must first register with the web site administrator. The administrator maintains a server with a web site, which sends and receives data relating to the games. The registration process includes identifying the location at which the player can be contacted to receive any awards won by playing the game. Additionally, a password is provided to allow the player access his or her account.

The player may also set up an account with the administrator in order to play certain fee-based games which are located on the menu. At the end of the registration process, a Windows-compatible game program which includes a number of versions of solitaire games is downloaded to the player's personal computer. In addition to the game software, "wav" or "midi" sound files are also sent to the player's computer which allow a player to listen to music during play of the game. A player can to listen to preselected midi files, or select his or her own sound files to play during game play. Other sound effects which are associated with game events include "deck shuffle," "deck deal," "card flip," "successful card play," "illegal move," and "potential move has been missed." In the event the deck is "busted" there are additional sound effects and graphics which are activated.

The present games are designed to be played in a tournament format which can accommodate thousands of players. The tournament elements add competition to the game and make it more attractive to play.

In a preferred embodiment, a player signs onto the Internet and then activates the tournament games software. A telephonic connection via Internet is established with the tournament game server which provides a menu screen which describes the games available, the jackpot and the time remaining before the tournament is closed.

The menu contains a number of solitaire games, each of which contains different features. Typically, a selected tournament will involve two to three iterations of the same game. In response to a game request, the server downloads "cards" to the player and any additional programming instructions required. The server may also download updated advertising materials, announcements from the server and software updates.

The server also keeps a record of the card deal seed which was provided to the player and the time the download was completed. The server then disconnects the Internet link to the player and play is initiated on the player's personal computer. Play proceeds until the game or games are completed. The player's computer then automatically contacts the server and reports the score and other information relating to the progress of the game. The player's score is then posted on a scoreboard which will reflect the current top five scores and the player's rank and score in relation to the top five players for the tournament.

Most of the program instructions for the games are downloaded to the player by way of a separate Internet connection which provides the programs for the games. The instructions transmitted from the server to the player act to enable certain features of the program, such as the existence of a wild card, the number of discard decks used or the location of the "fuzzy" or target bonus feature.

In one version of the tournament, play is allowed for only a certain time period. Players are each provided randomly shuffled decks of cards; thus, the tournament progresses with players using different decks. A player can play as often as he or she desires during the allotted time period. At the end of the predetermined period, usually set at twenty-four hours, persons achieving the top scores are awarded prizes.

In another game version known as the Sprint version, play will continue until a player reaches a predetermined score. This score is identified on the game menu in the "ends" column, where it denotes the point value which must be achieved by any player in order to end (and win) the tournament. For example, the end column may indicate the games ends at "25,700 pts." The first player to reach 27,500 points is the winner and will receive the prize. When the point value is reached, a new Sprint game will begin. The various features such as the wild card, the hold card and the target bonus as discussed herein can be activated in conjunction with the Sprint tournaments just like with the other games.

The player may also examine a second menu which displays the current high score and an identification of the player who achieved that score. Upon selecting the game, the server provides or deals the player with the necessary data and activates the program on the player's personal computer. The server may also download any advertising material to be displayed on the backs of the cards or scrolling messages. Information relating to the cards required to play a number of hands corresponding to the game are provided. The link is then disconnected from the server.

In a first game version, the cards dealt in a given hand to any player are randomly provided. Thus, each player in the tournament will be dealt a unique card deck or decks. In this first version the luck of the deal or draw will have some impact on the player's score. By providing some degree of chance in the games the novice player can effectively compete with expert players. This feature helps prevent novice players from being discouraged when playing in tournaments in which they believe their skills are less than those of experts. Additionally, as novice players continue to play their skill levels increase. In an alternative version of the game, each player in the tournament is provided identically arranged card decks. The identity of the exact card deck arrangement can be selected by using the time at which a player logs on and requests to play, or there could be a predetermined sequence of decks which are distributed to all players during a particular open tournament. In this second version the exercise of skill in the game is emphasized.

Most sites use banner ads as the major source of advertising revenue. The more people come to a web site, the more revenue can be earned, generated through advertising. In virtually all of the games, there is an incentive to play multiple games and increase the connection time between the players and the web site. With increased connection time, the advertising revenue of the site can be enhanced. However, the nature of the present game allows the player to play the game on his or her home computer, so the connection time is limited and intermittent. In this regard, this reduced connection time allows the server to provide more capacity but places technical restrictions on the display of advertising. In order to enhance the possibility of banner advertising revenue, the web site employs a number of features. Also, it should be recognized that when the web site is initially accessed conventional advertising banners may be displayed.

One manner to enhance revenue is to provide advertising on the card backs. The card back advertisement would be seen by the players throughout the play of the game. It may include a logo, web site or phone number. A further unique concept is to place a banner advertisement on the menu program which is downloaded to the desktop. This banner ad can be linked to the advertiser's web site. Thus, when a player initiates play from the desktop icon, the banner ad is displayed even though the web site has not been visited. The banner ad is controlled by the game server so the server can match certain tournaments to certain advertisers, coordinating the card back graphic and the banner ad. These banner ads that are displayed are actually embedded into the software which is download to the desktop, as opposed to merely being retrieved on demand from a possibly transient web site. The correlation of the banner ad with the card back helps to increase the amount of advertisement retention in the player's mind.

Lastly, in order to download the program the player must be registered with the web host; thus, the web host can develop an extensive database of registrants who are interested in playing games. In order to be eligible for the cash prizes, the player's home address information is required to be submitted during the registration. People who play solitaire or other card games on the Internet provide a unique demographic population to potential advertisers.

Figure 8A:
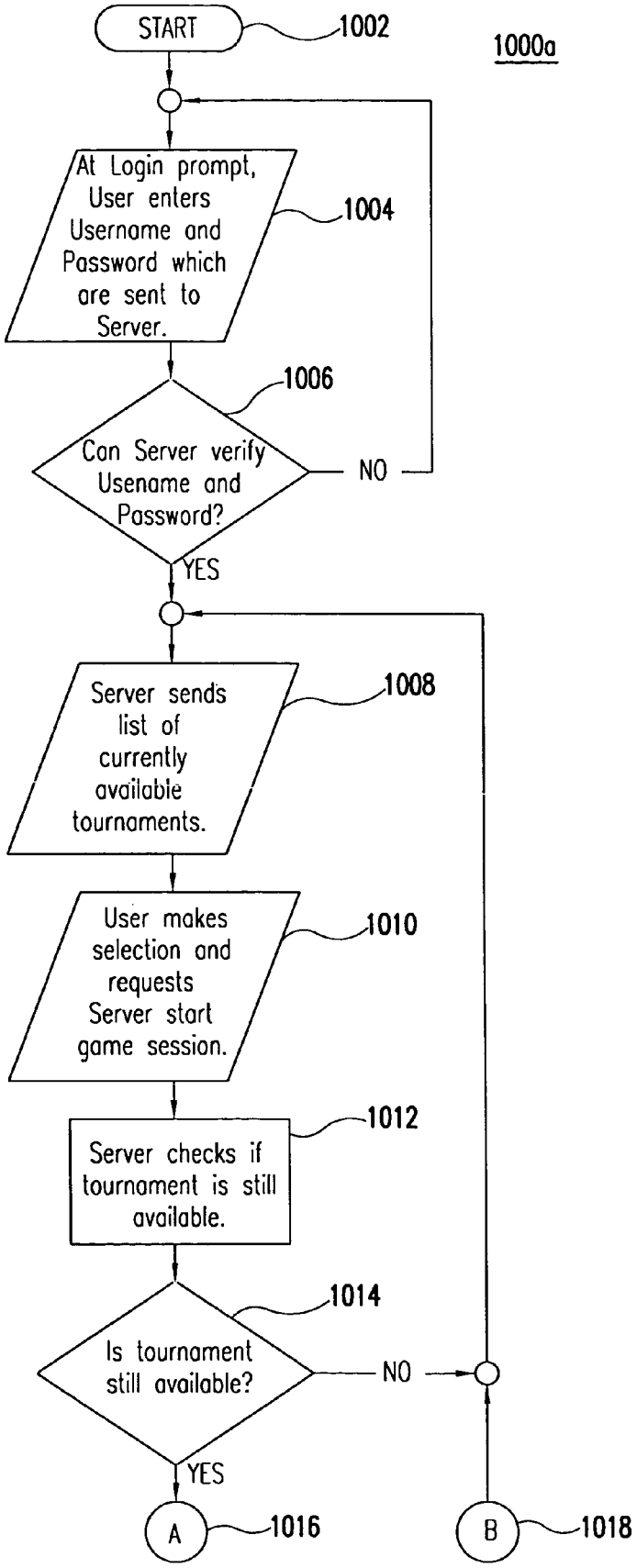
FIG. 8*a* is a flow chart depicting the sequence of communications between the personal computer and the server host.
Figure 8B:
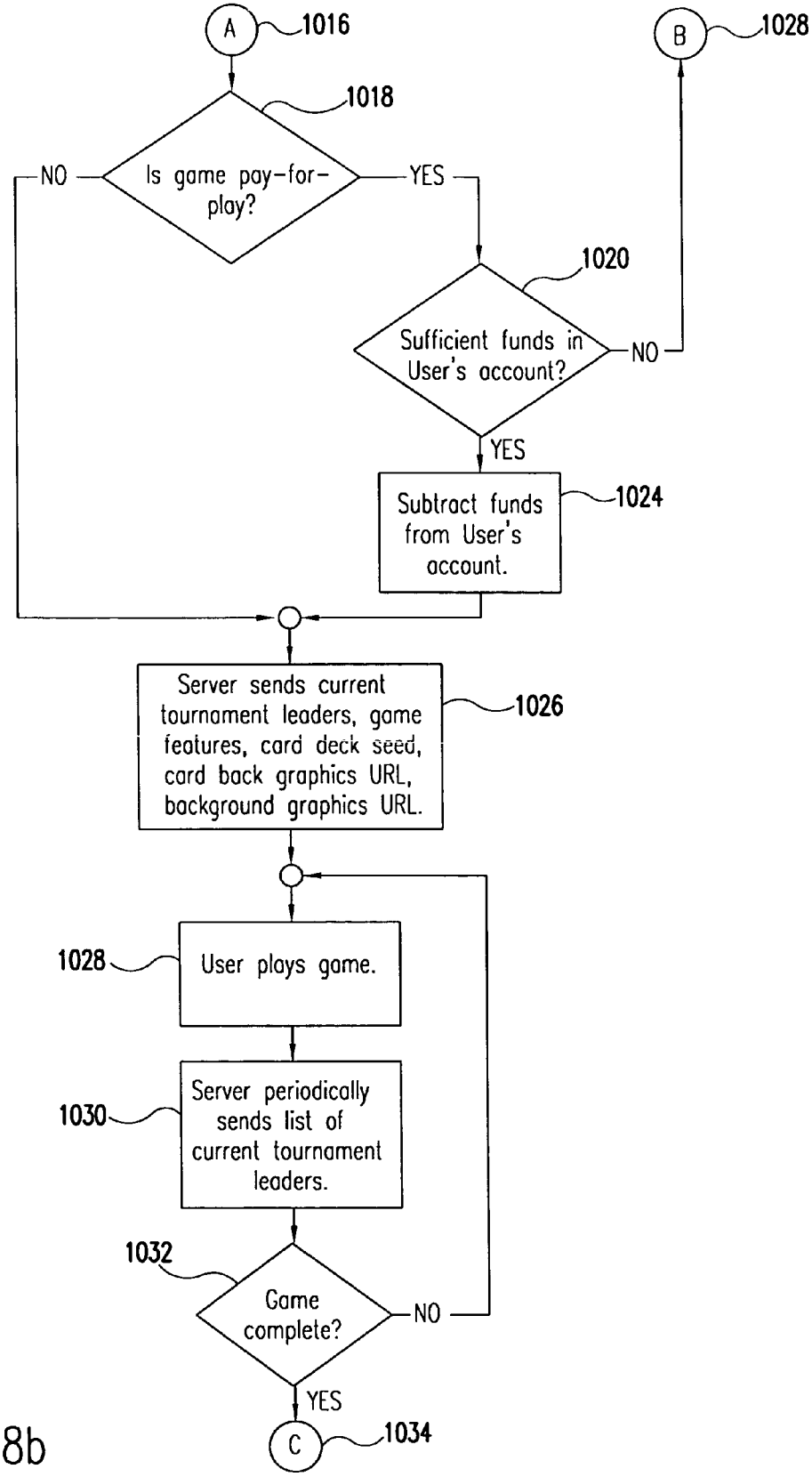
FIG. 8*b* is a continuation of the flow chart depicted in FIG. 8*a*
Figure 8C:
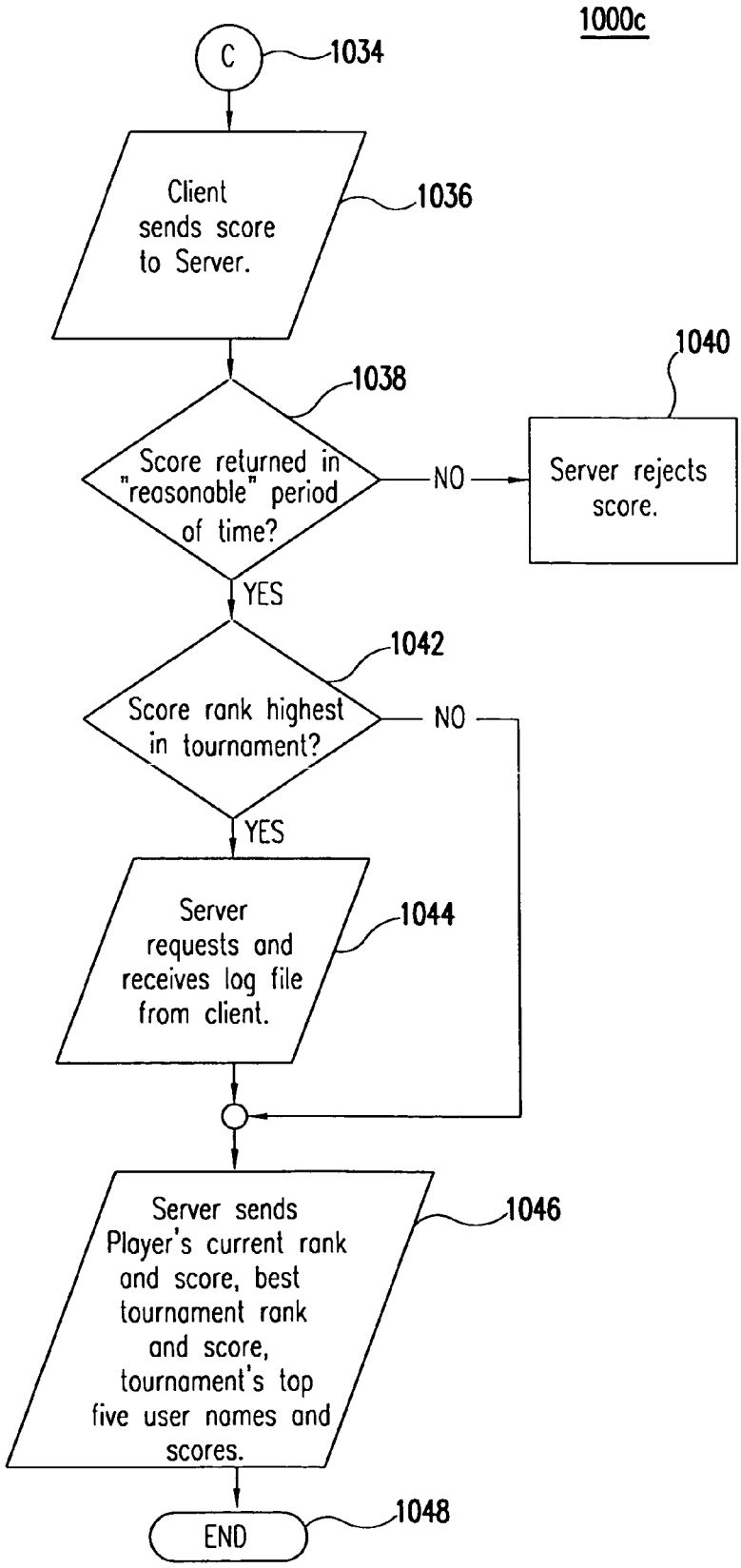
FIG. 8*c* is a continuation of the flow charts depicted in FIGS. 8*a* and 8*b*.

Now referring to FIG. 8*a*, after a connection with an Internet Service Provider is established, the game software is initiated at the player's or client computer at Start step 1002. The game software presents the player with a log in display and prompts the player to enter a player name and password. The player types a user name and password on the keyboard, and the information is sent to the server at step 1004. The server next attempts to validate the player name and password at step 1006. If the player name and password cannot be authenticated, the server commands the client to display the login prompt again.

If the player name and password have been determined by the server to be valid, the server sends to the client a list of tournaments that are currently available to play at step 1008. The player or user then makes a selection and requests that game begin at step 1010. Since the games and tournaments are of relatively short duration, the server verifies that the tournament selected by the user is still available to be played at step 1012. If the tournament is no longer available, the server sends a message to that effect to the Client, along with a new list of the tournaments available to be played.

Once the server verifies that the tournament desired by the user is in fact still available to be played, the server determines whether a fee must be paid by the user in order to play the desired tournament at step 1018. If a fee is required, the server examines the User's account to determine whether the account balance is sufficient to pay for the tournament at step 1020. If the User's account does not possess a sufficient quantity of finds a message to that effect is sent to the client computer, along with a current list of the tournaments available to be played so that the User can make another selection.

If a fee is required to play the desired tournament and the User's account has a balance sufficiently high to pay for the tournament, at step 1024 the fee is subtracted from the user's account. If no fee is required to play the tournament or if a fee was required and has been paid, the server proceeds to step 1026 and sends a packet of information to the client. Contained in the packet of information is a list of the current tournament leaders, a list of game features to enable for the tournament game or games, the seed number for the client to use while generating the sequence of cards in the card deck, the Internet Uniform Resource Locator from which to obtain the card back graphics, and the Internet URL from which to obtain the game background graphics. After the information packet has been received by the client and processed, game play begins as reflected in step 1028. While the user is playing the game, the server may periodically send a list of current tournament leaders to the client computer at step 1030. These transmissions keep the player informed of current standings and also help keep the Internet link between the client and server active. At the conclusion of the game, the client computer sends the user's final score to the server at step 1036.

The server computes the elapsed time between the time the game was started and the time the final score was received at step 1038. If the elapsed time seems unreasonable, as determined by algorithm at step 1040, the score is rejected.

If the server determines the user's score is valid, based upon the amount of time used to play the game at step 1042, the user's score is compared to the tournament's highest score. If the user's score is higher than the tournament's present highest score, the server requests that the client send the game log file to the server at step 1044. The log file contains a record of the original card deck sequence, each game move made by the user while playing the game, and a time stamp for each of the moves the user made. This log file is then stored on the server and can be examined for inconsistencies at a future time in cases where fraud is suspected.

Finally, the server sends status and rankings information to the client at step 1046. This information includes the user's current tournament score and tournament ranking, the tournament's highest score and ranking, and the tournament's five highest scores and the names of the users achieving those scores are displayed on a screen such as that depicted in FIG. 7. The player can then return to the game selection display page such as that represented by FIG. 6 to enter another tournament or quit the program at step 1048 by selecting the quit button. Selecting the quit button returns to the logon page. A further selection of the quit is required to stop running the program.

Figure 9:
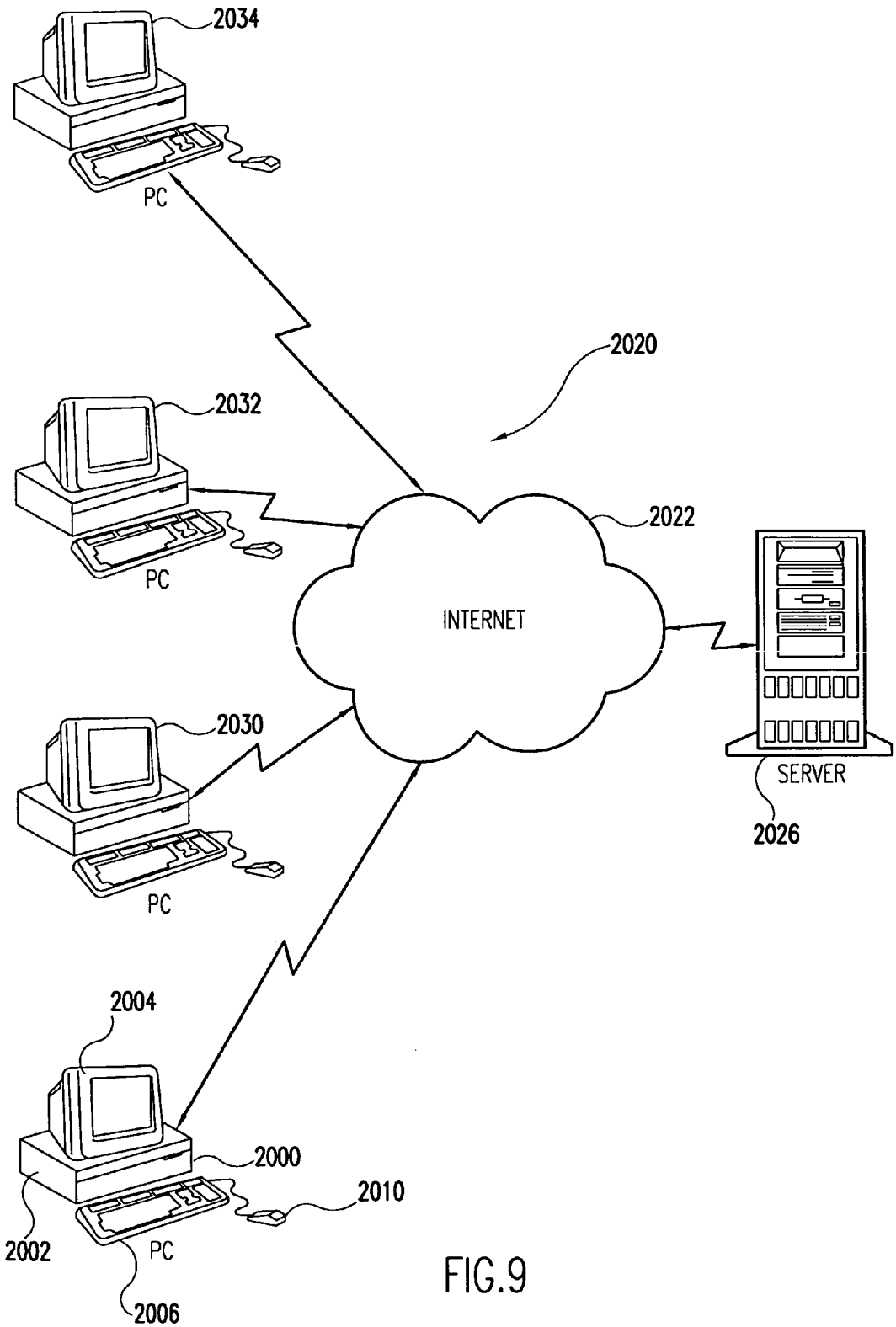
FIG. 9 is a pictorial representation depicting a data processing system in which the present invention may be implemented in accordance with a preferred embodiment of the present invention.

Referring now to FIG. 9, there is a pictorial representation, which depicts a system in which the present invention may be implemented. A personal computer 2000 is depicted which includes a system unit 2002, a video display terminal 2004, a keyboard 2006, storage devices 2008, which may include floppy drives and other types of permanent and removable storage media, and mouse 2010. Although the depicted representation shows a personal computer, other embodiments of the present invention may be implemented in other types of data processing systems, such as network computers, or other Internet appliances. Computer 2000 also preferably includes a graphical user interface that may be implemented by means of systems software residing in computer readable media in operation within computer 2000.

System 2020 is a network of computers in which the present invention may be implemented. System 2020 contains a network 2022, which is the medium used to provide communications links between various devices and computers connected together within system 2020. Network 2022 may include permanent connections, such as wire or fiber optic cables, temporary connections made through telephone connections or networks which employ wireless technology. A server 2026 is connected to network 2022 which has a built in storage unit and is used to provide game information and data to players on client computers. Clients 2000, 2030, and 2032 and 2034 are also connected to a network 2020. These clients 2000, 2030, and 2032 and 2034 may be personal computers or network computers, wherein a network computer is defined as any computer, coupled to a network, which receives a program or other application from another computer coupled to the network. Server 2026 provides data for operation of the game to clients 2000, 2030, and 2032 and 2034. In the depicted example, system 2020 is the Internet with network 2022 representing a worldwide collection of networks and gateways that use the TCP/IP suite of protocols to communicate with one another. At the heart of the Internet is a backbone of high-speed data communication lines between major nodes or host computers, consisting of thousands of commercial, government, educational and other computer systems that route data and messages. It is contemplated that system 2020 may also be implemented as a number of different types of networks, such as, for example, an intranet, a local area network (LAN), or a wide area network (WAN). Internet, also referred to as an "internetwork," is a set of computer networks, possibly dissimilar, joined together by means of gateways that handle data transfer and the conversion of messages from the sending network to the protocols used by the receiving network (with packets if necessary). When capitalized, the term "Internet" refers to the collection of networks and gateways that use the TCP/IP suite of protocols. Each client computer is provided application software which can be downloaded from the server. The application software is then executed after an Internet connection has been established with the players Internet service provider. The application software then is used to request and receive content from the server over the Internet.

Figure 10:
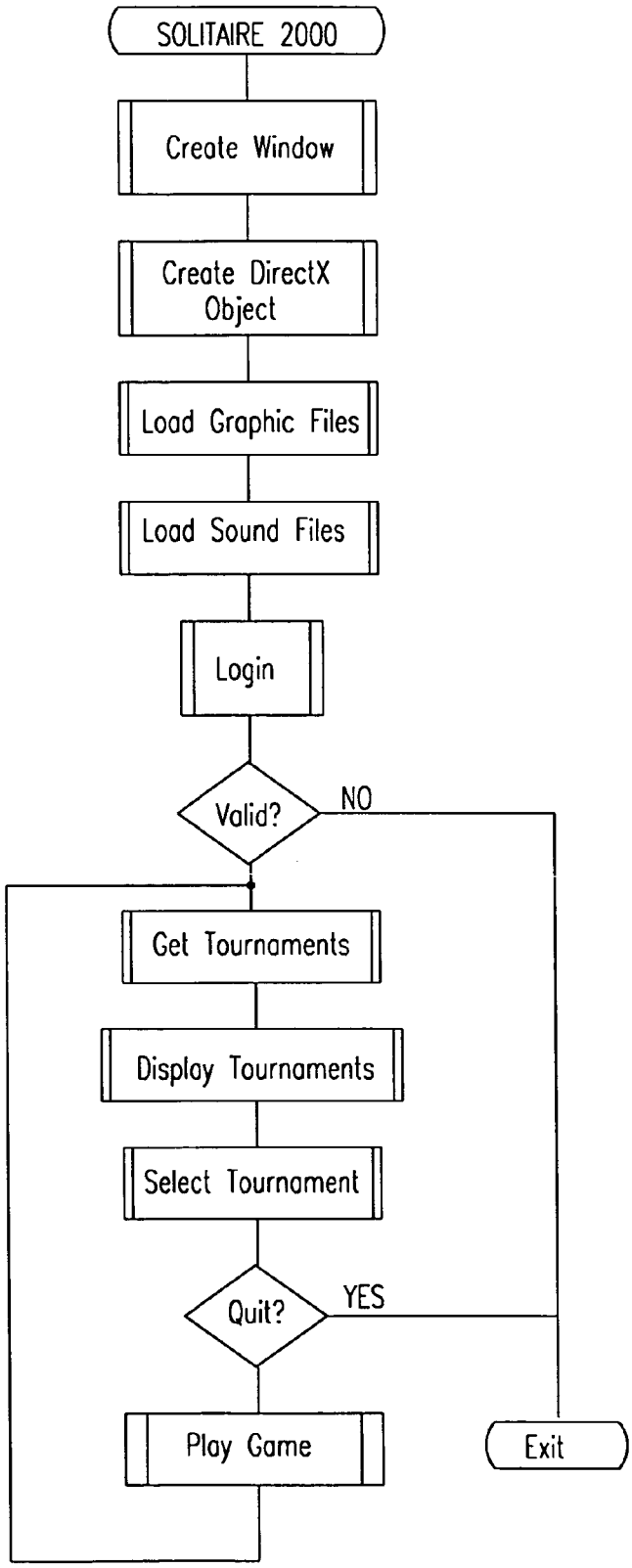
FIG. 10 is a flow chart depicting the sequence of logging into and playing the computer-based solitaire tournament game on a player's computer.

FIG. 10 depicts the sequence of a solitaire tournament game. After a connection with an Internet Service Provider is established, the game software is initiated to create a window at the player's or client's computer. The game software then checks the software that is residing on the player's drive to ensure that all software necessary for playing the game is available and to see if the software was updated. In the event that additional software module necessary to play the game is missing or the game software has been updated, the game software prompts the user to download any new necessary software. In a preferred embodiment, software necessary for the game includes DirectX, a Microsoft product that provides graphic files and sound files and is available from the Internet or from MicroSoft Corp. Then, the game software presents the player with a log in display and prompts the player to enter a player name and password. When the player name and password entered are invalid, the game software will prompt the player to exit the game without getting further information about the tournament. When the player name and password entered have been determined by the server to be valid, the server sends to the player/client a list of tournaments that are currently available to play which are displayed at the player's/client's computer. The player or user then makes a selection on the tournament game and requests that game begins. Before the game begins, the player has a chance to quit the game and exit the tournament. If the player selects to quit the game, the game software prompts the player to exit the game. Once the player foregoes the opportunity to quit the game, the game starts and the player plays the selected tournament. At the end of the selected tournament game, the game software prompts to get the tournaments available on the server and displays on the player's computer for the player to select. If the player selects a tournament and play, the game software prompts the player to continue to play the selected tournament. If the player selects to quit the game, the game software prompts the player to exit the game.

Figure 11A:
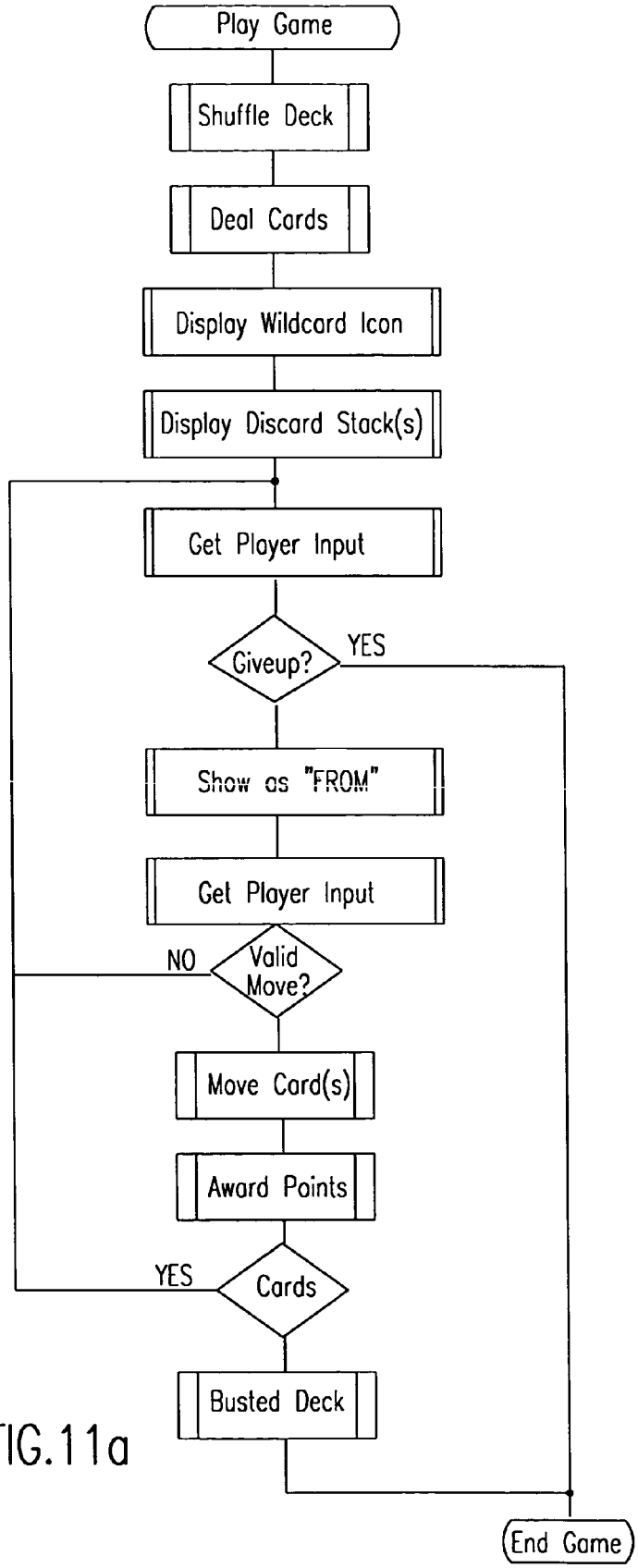
FIG. 11*a* is a flow chart depicting the detailed sequence of playing the computer-based solitaire tournament game on a player's computer with game features of a wild card and an option of prematurely quitting the game.
Figure 11B:
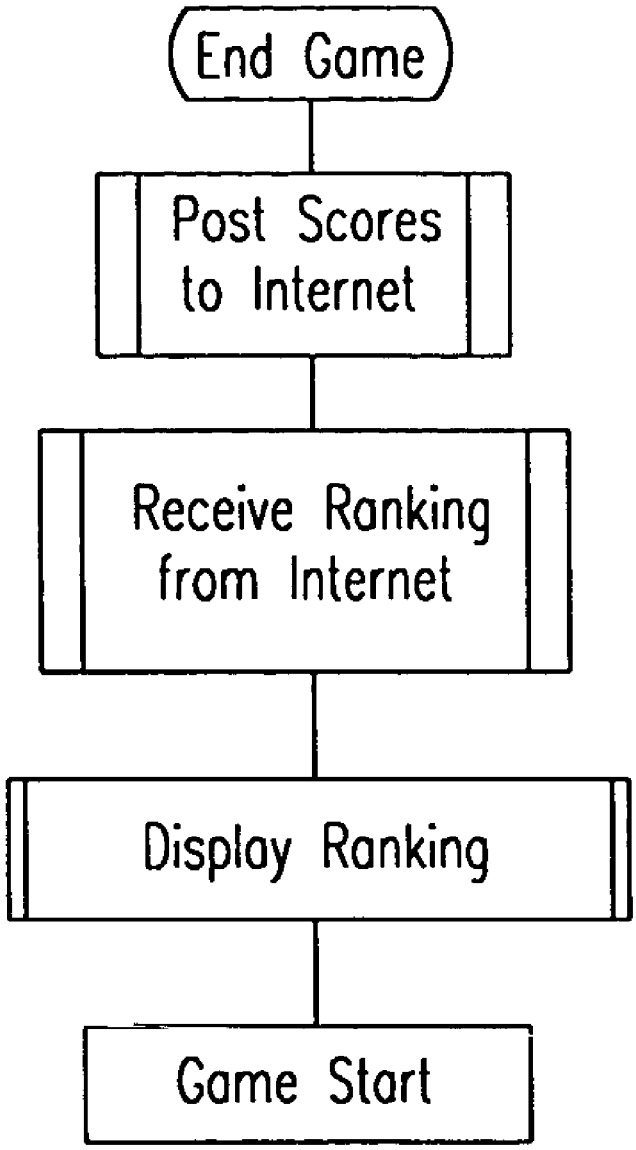
FIG. 11*b* is a continuation of the flow chart depicted in FIG. 11*a*.

Referring to FIGS. 11*a* and 11*b*, the steps of playing the computer-based solitaire tournament game are depicted in greater details with game features of a wildcard. As shown in FIG. 11*a*, once the player starts to play a selected tournament game, the game software prompts to shuffle deck and deal cards with the sequence determined by transfer of a "seed" determined by the server. The game software also display the wildcard icon on the player's computer and discard stacks including the four (4) ace stacks and the multiple player stacks whose number is controlled by the server.

The game software prompts to get the player's input. If the player selects to prematurely end the game, the game software prompts to end the game. If the player selects a card, an icon of "FROM" is shown on the card selected. Then, the game software gets the player's input on moving the card to another stack or column. When the game software determines that the move is valid, the card is moved to the selected stack/column and the player is awarded points accordingly and the player continues to select a card and play until the player has "busted the deck." If the game software determines that the move is invalid, the game software cancels out the move and prompts to get the player's input and continues the game.

Referring to FIG. 11*b*, at the conclusion of the game, the client/player computer sends the user's final score to the server to post scores to the internet. The server receives scores from multiple players and computes the ranking among them according to a predetermined tournament format. Then, such rankings are sent to each player's computer and displayed at the computers. Then, the player/client may choose to play a new game or a new tournament and continues.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

We claim:

1. A method for playing a computer-based Klondike-style solitaire game in a tournament framework comprising, selecting a tournament event having predetermined entry criteria and game features from a game menu, wherein said entry criteria comprises a tournament start time, retrieving input over the internet regarding said tournament event including data to generate a random card sequence and instructions to enable said game features associated with said selected tournament event from a server to a personal computer after said tournament start time and before a tournament ending event, wherein said game features comprise game rules and game patterns to extend play, and graphic elements, playing and scoring solitaire games according to said input by moving cards from play stacks to a column or an ace stack or between said columns in said personal computer and said score is based in part on the speed that a player successfully makes a move, transmitting scores from said personal computer over the internet to a server after said game is complete and before said tournament ending event occurs, comparing said score to the scores of other players that are entered into said tournament event, and, in the event that said transmitted score is determined to be a winning score, transmitting information comprising the game play sequence, and displaying said scores on a website that can be accessed by said players, and wherein said personal computer only receives input from said internet server before and after said solitaire game.

2. The method for playing a computer-based Klondike-style solitaire game according to claim 1 further comprising comparing a score of said solitaire game with scores of other players in said internet server to obtain rankings of the players, and displaying said score and said rankings on said computer.

3. The method for playing a computer-based Klondike-style solitaire game according to claim 1 wherein said graphic elements comprise a play field background and a card back graphics.

4. The method for playing a computer-based solitaire game according to claim 1 wherein said scoring method is selected from said group consisting of comprising scoring by a speed of each successful move, scoring by a total number of successful moves and said combination thereof.

5. The method for playing a computer-based solitaire game according to claim 4 wherein said scoring by a speed of each successful move is indicated by an elapsed/countdown time indicator.

6. The method for playing a computer-based Klondike-style solitaire game according to claim 1 wherein said game pattern and rules to extend play comprise multiple discard play stacks from which a card may be moved to said column or ace stack in a conventional Klondike solitaire game.

7. The method of playing a computer-based Klondike-style solitaire game according to claim 1 wherein said game pattern further comprises a target indicator displayed in association with a column stack, and when a player removes all cards in said column stack, the player is awarded a bonus score.

8. The method for playing a computer-based solitaire game according to claim 1 wherein said game pattern and rules to extend play further comprise a wild card feature in which if a player chooses a wild card to place on a desired location, a first card that can be played at said desired location is marked in said play stack or said column, and when said first card is revealed later, said first card is removed from play and a next card in said column is revealed.

9. The method for playing a computer based Klondike-style solitaire game according to claim 1 wherein said game pattern and rules to extend play further comprise a play stack for future play in which a player moves a card from a discard play stack to said future play stack and said card on said future play stack is available for play at any time during the game.

10. The method for playing a computer-based solitaire game according to claim 1 wherein said game pattern comprises a method for a player to prematurely end said game.

11. A computer-based Klondike-style solitaire tournament game comprising a network connection to a server for retrieving an input and for comparing scores, and a control system for a player, said control system comprising means for operating on said input means to transmit scores to said server, and means for displaying said input and said comparison results to said players, wherein said input comprises a scoring method and a game pattern which is unique to each player and said input is controlled and predetermined by said server, and said game pattern comprises game features, graphic elements, and distribution of cards throughout a play field for the play of a particular game, said network connection only retrieving input and comparing scores during at least one of before and after the play, of the particular game.

12. A method for operating a tournament Klondike-style solitaire game over the internet comprising establishing communication over said internet between a central server and a plurality of players' computers, downloading an input onto said players' computers, said input comprising a scoring method, a game pattern, and a tournament structure, said game pattern comprising data to generate a random sequence of cards and game features that extend play, which are controlled and predetermined by said central server, wherein said game pattern is likely unique to each player, said game features selected from a group consisting of a multiple discard play stack feature, a play later feature, a wild card feature, a multiple game feature, a sprint game feature, and a bust the deck feature;

re-accessing periodically to each said player's computer from said central server, transferring information relating to each said player's identity, the game, and game result to said central server, comparing scoring results from multiple players in said central server according to said tournament structure, displaying said comparison results on said player's computer, and wherein said player's computer only receives said input prior to playing a game, and said player's computer optionally display commercial banners from said server, and said game pattern comprises game features, graphic elements, and distribution of cards throughout a play field for the play of a particular game.

13. The method for operating a Klondike-style solitaire tournament game over the internet according to claim 12 wherein said tournament structure is that scores are collected over a predetermined length of time period, players are provided data that results in a randomly shuffled decks of cards, and a player with a highest score within said period wins.

14. The method for operating a Klondike-style solitaire tournament according to claim 12 wherein said tournament structure is that said game progresses until a first player exceeds a predetermined score and said tournament begins at a predetermined time.

15. The method for operating a Klondike-style solitaire tournament game over the internet according to claim 12 wherein said tournament structure is that a player has a predetermined length of time period to make a successful play and each successful play is credited with a predetermined non-decreasing point value, and a player with highest point value within said period wins.

16. The method for operating a Klondike-style solitaire tournament game over the internet according to claim 12 wherein said tournament structure is that a player first to bust a deck wins.

17. The method for operating a Klondike-style solitaire tournament game over the internet according to claim 12 wherein said tournament structure is that players who have never previously won before are capable of playing in said game.

18. The method for operating a Klondike-style solitaire tournament game over the internet according to claim 12 wherein said scoring method is selected from said group consisting of scoring by a speed of each successful move, scoring by a total number of successful moves and said combination thereof.

19. The method for operating a Klondike-style solitaire tournament game over the internet according to claim 18 wherein said scoring by a speed of each successful move is indicated by an elapsed/countdown time indicator.

20. The method for operating a Klondike-style solitaire tournament game over the internet according to claim 12 wherein said game pattern comprises multiple play stacks from which cards may be moved to said column or said ace stack.

21. The method of operating a Klondike-style solitaire tournament game over the internet according to claim 12 wherein said game pattern further comprises a target indicator displayed in association with a column stack, and when a player removes all cards in said column stack, the player is awarded a bonus score.

22. The method for operating a Klondike-style solitaire tournament game over the internet according to claim 12 wherein said game pattern comprises a wild card feature in which if a player chooses a wild card to place on a desired location, a first card that can be played at said desired location is marked in said play stack or said column, and when said first card is revealed later, said first card is removed from play and a next card in said column is revealed.

23. The method for operating a Klondike-style solitaire tournament game over the internet according to claim 12 wherein said game pattern comprises a play stack for future play in which a player moves a card from a play stack to said future play stack to reserve for future use.

24. The method for operating a Klondike-style solitaire tournament game over the internet according to claim 12 wherein said game pattern comprise a seed of a random number generated by said central server to decide a deal card sequence in said player's computer.

25. The method for operating a Klondike-style solitaire tournament game over the internet according to claim 12 further comprising verifying user name and ID of said player, and deducting money from said player's account if said game is a paid-for game before the step of downloading an input into said player's computer.

26. The method for operating a Klondike-style solitaire tournament game over the internet according to claim 12 wherein said graphic elements comprise a play field background and a card back graphics.

27. The method for operating a Klondike-style solitaire tournament game over the internet according to claim 12 wherein said game pattern comprises a method for a player to prematurely end said game.

28. The method as described in claim 1 wherein said tournament ending event comprises a predetermined time.

29. The method as described in claim 1 wherein said tournament ending event comprises reaching a predetermined score.

* * * * *